United States Patent [19]

Daenen et al.

[11] 4,379,030

[45] Apr. 5, 1983

[54] ALUMINUM ELECTROPLATING SOLUTION

[75] Inventors: Theo E. G. Daenen; Gerardus A. R. Van Dijk; Steven A. Stolk, all of Eindhoven, Netherlands

[73] Assignee: U.S. Philips Corporation, New York, N.Y.

[21] Appl. No.: 339,932

[22] Filed: Jan. 18, 1982

[30] Foreign Application Priority Data

Feb. 6, 1981 [NL] Netherlands ..... 8100570

[51] Int. Cl.[3] ..... C25D 3/44

[52] U.S. Cl. ..... 204/14 N

[58] Field of Search ..... 204/14 N, 39

[56] References Cited

U.S. PATENT DOCUMENTS 4,145,261 3/1979 Daenen ..... 204/14 N 4,222,827 9/1980 Daenen ..... 204/14 N

*Primary Examiner*—T. M. Tufariello

*Attorney, Agent, or Firm*—Norman N. Spain

[57] ABSTRACT

Electrolyte liquid for the electrodeposition of aluminum, consisting of a solution of a ligand of one or more aluminum halohydrides in an aprotic solvent. The ligand is, for example, tetrahydrofuran or triethylamine. This liquid makes it possible to deposit ductile aluminum up to high current densities.

5 Claims, No Drawings

ALUMINUM ELECTROPLATING SOLUTION

The invention relates to an electrolyte liquid for the electrodeposition of ductile aluminum onto an electrically conducting substrate, to the method of electrodepositing ductile aluminum onto a substrate and to the products thus obtained.

U.S. Pat. No. 3,355,368 discloses such a liquid which consists essentially of an organic complex of an aluminum halohydride and an ether, the liquid containing approximately 0.1–5% by volume of free ether. In order to prepare a bath of such a type, a solution of $AlCl_3$ and $LiAlH_4$ in ether is brought together in an equimolar ratio, the halohydride, for example $AlHCl_2$, then being formed. The excess ether is evaporated at the boiling point of the solvent until the said quantity of residual solvent is obtained. The bath is used for electrolysis at a temperature between the melting point of the aluminum and the boiling point of the solution. This method of preparation intends to eliminate fire risks. In spite of the reduced risk of fire or explosion of the bath, it is nevertheless recommended to operate the bath under a protective atmosphere. Owing to this cumbersome method of preparation, said electroplating bath is not very attractive for practical use.

Furthermore, U.S. Pat. No. 4,145,261 describes an electrolyte liquid which contains an aprotic solvent with an ether structure and a second, inert aprotic solvent or a solvent which is capable of forming a coordination compound, in which anhydrous aluminum chloride and a metal hydride have been dissolved. The solvent with ether structure is defined by the formula $RO—(CH_2)_m—O(CH_2)_nOR^1$, wherein m and n are integers between 1 and 6, and R and $R^1$ are alkyl groups.

This liquid has the disadvantage that aluminum can only be deposited with it when using a current density of up to 1 A/dm$^2$ and that the aluminum obtained is usually brittle.

According to the invention, it has now been found possible to deposit aluminum when using a current density of up to at least 4 A/dm$^2$.

According to the invention, the electrolyte liquid which comprises an organic complex of an aluminum halohydride, is characterized in that the liquid consists of a solution of one or more compounds $AlH_xCl_y.tL$ in an aprotic solvent of the structure $R[O—(CH_2)_m—]O—(CH_2)_n—OR^1$, wherein $x+y=3$ and both x and y amount to at least 0.25 and not more than 2,75, t is an integer selected from 1, 2, 3 or 4, L is a ligand forming a coordination compound with the halohydride, R and $R^1$ are alkyl groups, m and n are integers between 1 and 6 and p has a value of 1, 2 or 3.

It appears to be advantageous, compared with prior art liquids that the liquids in accordance with the invention do not contain Li. This apparently allows the use of higher current densities in the electrolysis and results in the aluminum deposited therewith being ductile.

The preparation of the compounds $AlH_xCl_ytL$ where $L=(CH_2)_4O$ (tetrahydrofuran) and triethylamine $(C_2H_5)_3N$, respectively, is described in the manual "Hydrides of the Elements of Main Groups I–IV" by E. Wiberg and E. Amberger, Elsevier, Amsterdam, London, New York 1971. Additional possible compounds designated by L include trimethylamine, tripropylamine, 2-methyl-tetrahydrofuran and 2,3-dimethyl tetrahydrofuran.

The invention will now be further explained on the basis of the following embodiments.

EXAMPLE 1

60 g of crystalline $AlH_2Cl.N(C_2H_5)_3$ are dissolved in 200 ml of diethylene glycol diethylether. The conductivity of this solution is 2.6 mS cm$^{-1}$. Electrolysis tests are performed at room temperature at 0.5, 1, 2, 3, 4 and 5 A/dm$^2$. Properly ductile aluminum is obtained up to 4 A/dm$^2$. The bath voltage at 1 A/dm$^2$ is 3.6 V. The aluminum layers obtained, which are approximately 11 μm thick, properly adhere to the copper substrate and have a satisfactory ductility of more than 4 bends.

One bend consists of bending the aluminum deposit peeled from the substrate through 180°, creasing at the fold, returning it to its original flat position and pressing along the crease to flatten it.

EXAMPLE 2

55.8 g of $AlCl_{1.5}H_{1.5}—2(CH_2)_4O$ are dissolved in 150 ml of distilled diethylene glycol dimethyl ether, said solution having a conductivity of 3.2 mS cm$^{-1}$. At 1 A/dm$^2$ the bath voltage is 3.4 V. Properly ductile aluminium is obtained in the entire current density range from 0.5 to 4.0 A/dm$^2$, inclusive.

What is claimed is:

1. An electrolyte liquid for the electrodeposition of aluminum onto a substrate, which liquid contains an organic complex of an aluminum halohydride, characterized in that the liquid consists of a solution of one or more compounds $AlH_xCl_y.tL$ in a aprotic solvent having the structure $$R[O—(CH_2)_m]_p—O—(CH_2)_n—OR^1,$$

wherein $x+y=3$ and both x and y amount to at least 0.25 and not more than 2.75, t is an integer selected from 1, 2, 3 or 4

L is a ligand forming a coordination compound with the halohydride,

R and $R^1$ are alkyl groups and m and n are integers between 1 and 6 and p has a value of 1, 2 or 3.

2. An electrolyte liquid as claimed in claim 1, characterized in that the ligand L is tetrahydrofuran.

3. An electrolyte liquid as claimed in claim 1, characterized in that the ligand L is triethylamine.

4. A method of electrodepositing ductile aluminum onto an electrically conducting substrate using an electrolyte liquid as claimed in any of the claims 1 to 3, inclusive.

5. A substrate coated with a layer of ductile aluminum obtained in accordance with claim 4.

* * * * *

UNITED STATES PATENT AND TRADEMARK OFFICE

CERTIFICATE OF CORRECTION

PATENT NO. : 4,379,030

DATED : April 5, 1983

INVENTOR(S) : THEO E.G. DAENEN ET AL

It is certified that error appears in the above—identified patent and that said. Letters Patent is hereby corrected as shown below:

Col. 1, Line 48, "$)m-]$" should be --$)m-]p$--.

Signed and Sealed this

Second Day of August 1983

[SEAL]

Attest:

GERALD J. MOSSINGHOFF

Attesting Officer

Commissioner of Patents and Trademarks